United States Patent [19]

Lenzing

[11] 4,345,224

[45] Aug. 17, 1982

[54] CONTACT SPRING ARRANGEMENT

[75] Inventor: Richard S. Lenzing, Farmington, Conn.

[73] Assignee: General Electric Company, New York, N.Y.

[21] Appl. No.: 229,908

[22] Filed: Jan. 30, 1981

[51] Int. Cl.[3] ..... H01H 50/02

[52] U.S. Cl. ..... 335/132; 29/602 R

[58] Field of Search ...../ 335/132, 198; 29/602 R, 29/622

[56] References Cited

U.S. PATENT DOCUMENTS

| | | | |
|---|---|---|---|
| 2,513,695 | 7/1950 | Valkenburg | 335/132 |
| 2,943,170 | 6/1960 | Vradenburgh | 335/128 |
| 3,643,190 | 2/1972 | Puetz et al. | 335/132 |
| 3,806,849 | 4/1974 | Hughes | 335/132 |
| 4,087,770 | 5/1978 | Kuhn et al. | 335/132 |

*Primary Examiner*—Harold Broome

*Attorney, Agent, or Firm*—Walter C. Bernkopf

[57] ABSTRACT

A contactor assembly has a moveable contact carrier extending through an arc chute containing stationary terminals. The arms of the contact carrier support moveable contact bridges that are spring mounted on pin members. The pin members are specially configured to facilitate initial insertion of the spring between the pin head and the contact bridge with minimal radial displacement of the spring turns. The head of the pin member has a thickness smaller than the inside diameter of the smallest turn of the helical spring. The head and neck are specially configured in the direction orthogonal thereto, to facilitate insertion of the spring at an oblique angle such that one end of the spring snaps over the flanged end of the pin before the other end.

9 Claims, 12 Drawing Figures

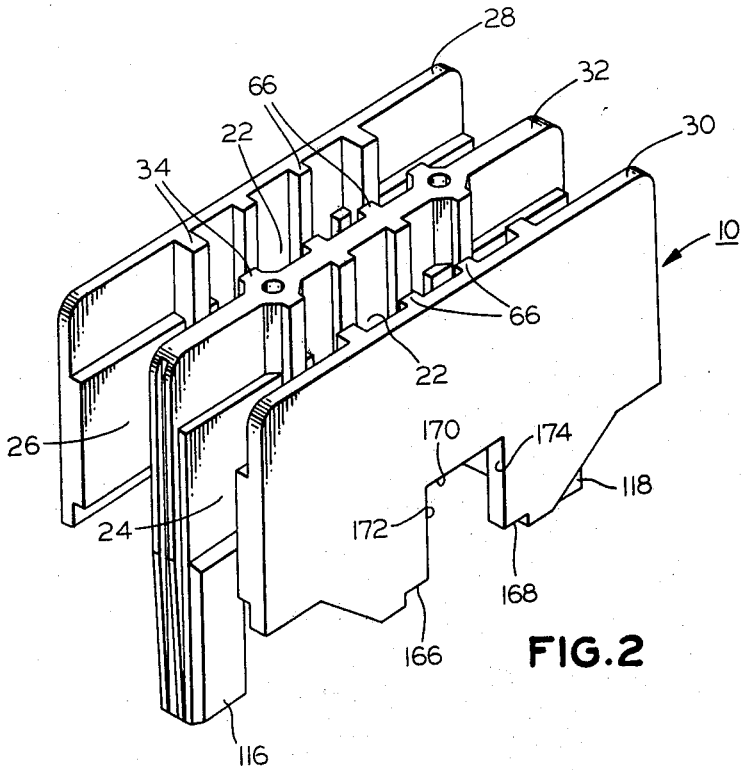
FIG.2
FIG.7
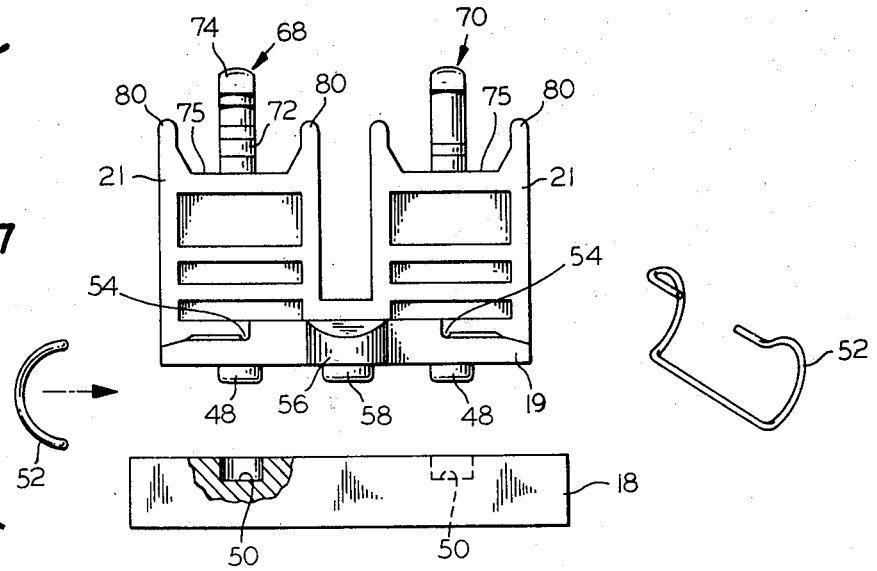

CONTACT SPRING ARRANGEMENT

BACKGROUND OF THE INVENTION

This invention relates to electrical contactor assemblies and more particularly to spring mounting moveable contact bridges in juxtaposition with stationary contact means.

Prior art contactor arrangements include those where a moveable contact carrier supports a spring mounted contact bridge. Upon attraction of the armature to the energized electric magnet, the contact carrier moves to initially bring the contact bridge into engagement with the stationary contacts. As the contact carrier moves further, the spring abutting the contact bridge is compressed to provide adequate contact pressure even with contact wear.

Various arrangements have been utilized for resiliently mounting the contact bridge on the contact carrier. For example, the contact bridge commonly extends through a window in the moveable contact carrier and is resiliently mounted by a spring extending between the top wall of the window and the top surface of the bridge. However, the assembly of this arrangement is difficult and time consuming. A contact bridge has been supported on a contactor having a pin member extending through an opening in the bridge and a spring interposed between the pin head and the surface of the contactor bridge. However, insertion of the spring results in excessive radial expansion of the spring as it expands over the pin head. This limits the diameter of the spring wire in respect to the diameter of the spring and thus precludes the spring from providing the optimum force required during the closing of the contactor. Also, insertion of the spring on a mass production basis could be further simplified.

OBJECTS OF THE INVENTION

It is therefore an object of the invention to provide an improved contactor incorporating a simplified arrangement of a spring mounted contactor bridge.

It is a further object of the invention to provide such a simplified arrangement that is adapted for more efficient production assembly.

It is an additional object of this invention to provide an improved arrangement for spring mounting a contactor bridge which permits initial insertion of the spring with minimal radial spring expansion, and thus permits use of springs providing optimum force.

Other objects of the invention will be pointed out and understood hereinafter.

SUMMARY OF THE INVENTION

In accordance with a broad aspect of this invention, there is provided an electromagnetic contactor having a contact carrier moveable responsive to movement of an armature. A pin member extends from the contact carrier through an aperture in the contact bridge. In a preferred embodiment, a longitudinally moveable contact carrier has arms extending between parallel walls of an arc chute. Contact bridges are supported on the surface of the arms and retained by pins extending from the arms and are juxtaposed in respect to stationary contacts supported in compartments formed between the walls of the arc chute.

The pin member has head and neck portions. A helical spring adapted for insertion between the head portion and the contact bridge has a top turn, and additional turns of diameter greater than that of the top turn. The head portion has a width that permits ready passage of the top turn. Orthogonally thereto, the head portion is contoured to comprise: displaced flanged end portions adapted to capture the top turn of the spring subsequent to its insertion, an apex disposed intermediate the flanged end portions, and first and second contour surfaces of unequal slope extending from the apex to the flanged end portions. The neck portions are configured to facilitate insertion of the spring at an oblique angle so that the top turn of the spring sequentially engages the opposing flanged end portions. Accordingly, radial spring expansion in minimized and spring insertion with simple tooling is facilitated.

The novel features believed characteristic of this invention are set forth with particularity in the appended claims. The organization and manner of operation of the invention together with further objects and advantages thereof may best be understood with reference to the following description taken in connection with the accompanying drawings. Particular attention is directed to the first three subsections of the specification entitled "General Description and Stationary Contacts," "Moveable Contact Carrier" and "Assembly of Contact Bridge on Contact Carrier." The contactor described herein also contains additional features which are the subject of other copending applications (Ser. Nos. 230,166 and 230,165) concurrently filed in the name of the subject inventor.

BRIEF DESCRIPTION OF THE DRAWING

FIG. 2 is a top perspective view of the molded arc chute showing the separate compartments for the contacts;

FIG. 7 is a front view of the moveable contact carrier, armature and spring clips;

DESCRIPTION OF THE PREFERRED EMBODIMENT

For convenience, the description is subdivided into the following subheadings:

1. General Description and Stationary Contacts
2. Moveable Contact Carrier
3. Assembly of Contact Bridge on Contact Carrier
4. Assembly of Electromagnet
5. Coil Assembly

GENERAL DESCRIPTION AND STATIONARY CONTACTS

Figure 1:
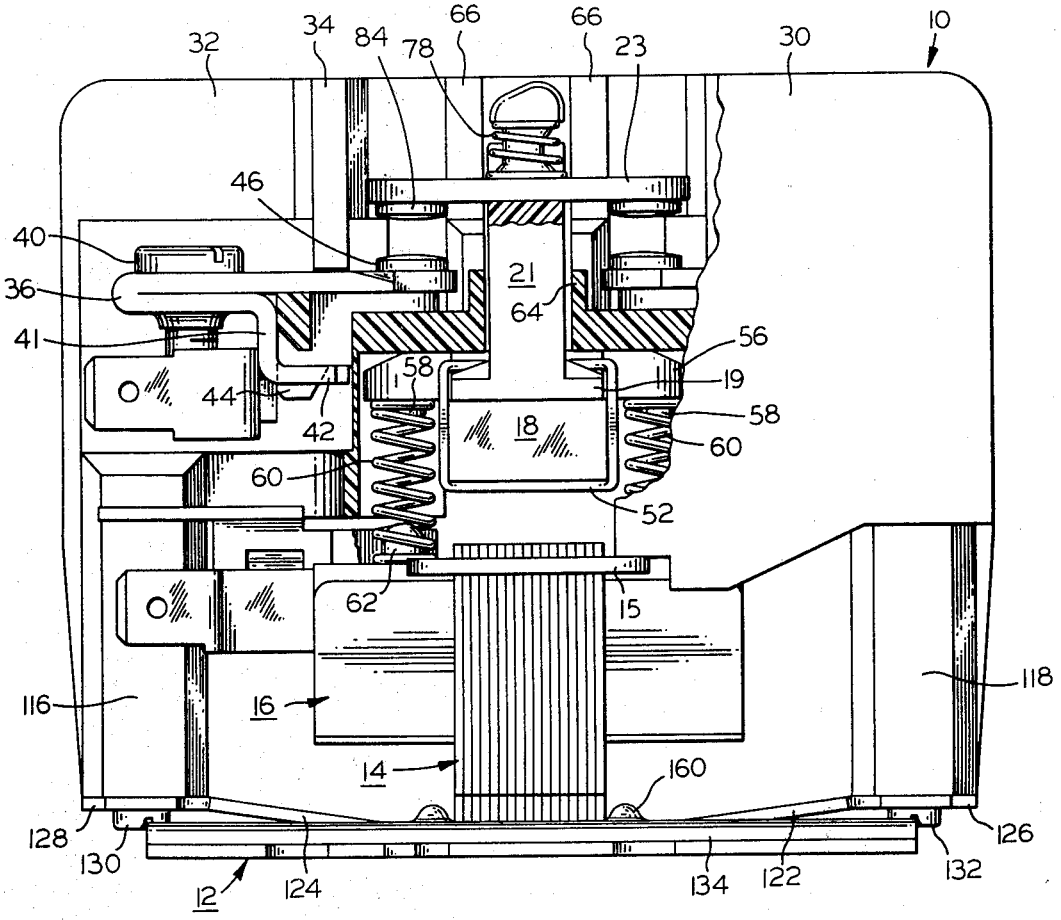
FIG. 1 is a sideview of the assembled contactor wherein a sidewall of the arc chute has been broken away to show details of the assembled components therein.
Figure 3:
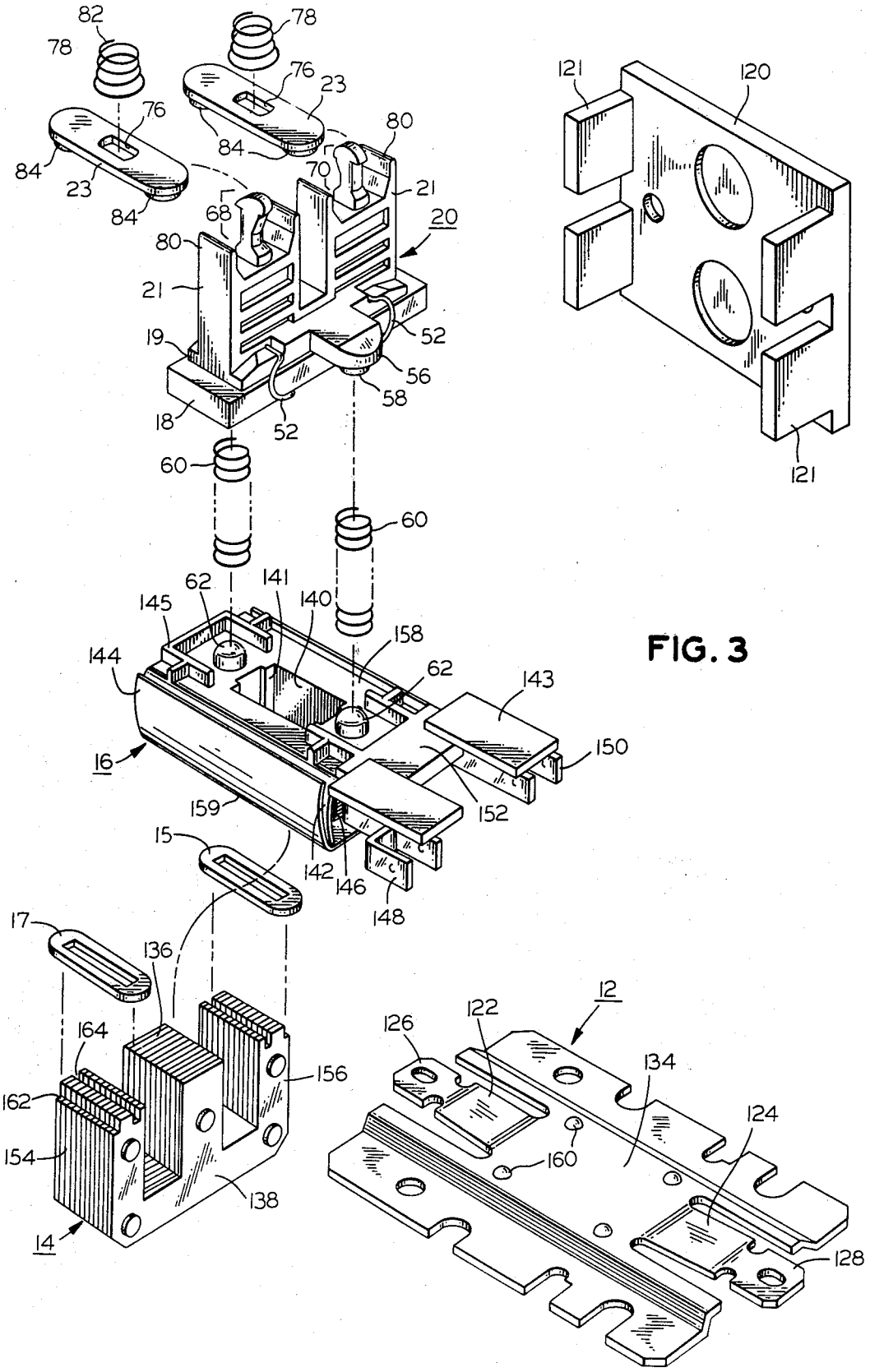
FIG. 3 is an exploded view of additional components of the contactor.
Figure 4:
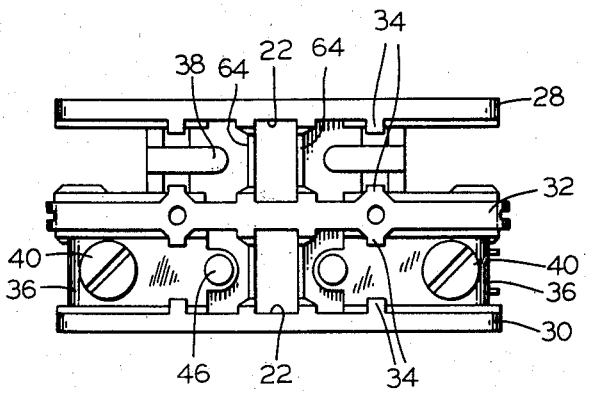
Figure 5:
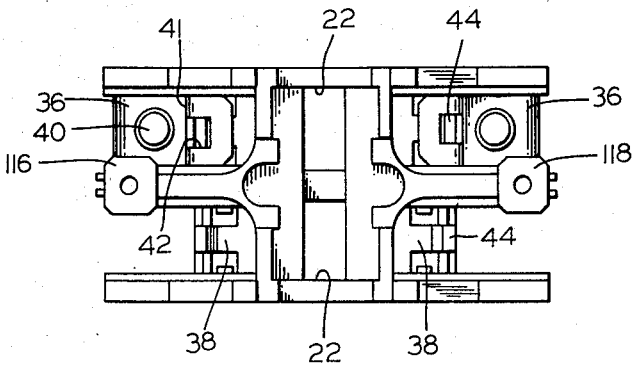

As shown in FIGS. 1, 2 and 3, the contactor comprises two main structural supporting elements: a main insulating member, i.e. arc chute 10 and support member 12. These capture and support a stationary electromagnet assembly comprising stationary magnet 14, coil assembly 16 and pole shader rings 15 and 17. A moveable contact carrier 20 has a moveable magnet member, i.e. armature, 18 fixed to its base 19 and has two arms 21 extending through apertures 22 of the arc chute (FIGS. 4 and 5). A moveable contact bridge 23 is spring mounted near the top of each arm 21.

Figure 6:
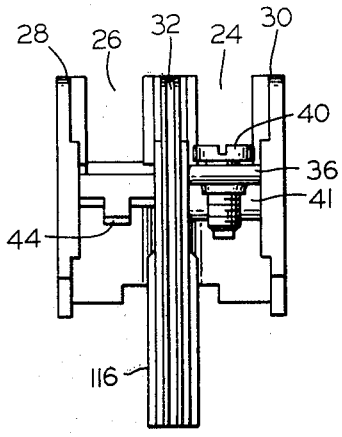
FIGS. 4, 5 and 6, respectively, are, top, bottom and side views of the arc chute with one set of stationary contact members installed.

As illustrated in FIGS. 2, 4 and 6, arc chute 10 has compartments 24, 26 formed at its top between oppositely disposed sidewalls 28, 30 and intermediate wall 32. Each of these compartment walls 28, 30 and 32 has ribs 34 extending almost to the bottom of the respective compartments. Four stationary contact power terminals 36 are force fit between the bottom of respective pairs of ribs 34, extending between the intermediate and sidewalls, and bottom wall portions 38 of the compartments. Each compartment contains and electrically isolates the pair of stationary contact terminals assemblies of one pole. (FIGS. 4–6 illustrate only one pair of contact terminals). Each stationary contact terminal assembly is clamped to wall portion 38 of the arc chute by terminal screw 40. As illustrated in FIG. 1, each contact terminal assembly 36 comprises a single metallic member bearing a contact button 46 at its upper end, and is bent so as to have contiguous upper and lower portions provided with openings for screw 40. The lower portion, containing a threaded opening, adjacent to this bend, is additionally bent to provide a downwardly extending portion 41 and an apertured horizontal end portion 42. The terminal assemblies are clamped by tightening the terminal screw 40 which causes the aperture in end portion 42 to engage the downwardly extending projection 44 of the arc chute.

MOVEABLE CONTACT CARRIER

FIGS. 1, 3 and 7 illustrate moveable contact carrier 20. Its horizontal base 19 has two bosses 48. Armature 18 is juxtaposed on the base 19 so that these bosses nest in armature indentations 50. Spring clips 52, each comprising C-shaped side members connected by a longitudinal member, slide over the bottom of the armature and the sloped upper edges of base 19 to snap in place in indentations 54 on the upper surface of the base. The nesting of the bosses in the indentations restricts lateral motion. The spring clips 52 avoid a rigid connection and even the shock load distribution during contactor operation. Base 19 has lateral arms 56 with downward extending bosses 58 (FIGS. 3 and 7). Two return springs 60 are positioned between bosses 58 and the upward extending bosses 62 of the coil assembly 16 (FIGS. 1 and 3). Arms 21 of the moveable contactor carrier extend through apertures 22 of the horizontal wall of the arc chute. These apertures are formed by the bounding portions of the side and intermediate walls and of laterally extending flange portions 64 (FIG. 4). The upper portion of the arm is also positioned between and adjacent to, vertical ribs 66 that extend inwardly from the side and inner walls (FIGS. 1 and 2). Arms 21 have flanges 80 extending upward on opposing sides of the upper horizontal surface 75 of the arms (FIG. 7). Thus, the sidewalls of the arms adjacent to the side and intermediate walls and ther vertical ribs of the arc chute extend upward of the horizontal surface 75. This arrangement minimizes lateral excursion during the longitudinal movement of the contact carrier.

Each arm 21 has a pin member (68 and 70) comprising a neck 72 and a head 74. The pin member extends longitudinally from the arm, i.e. orthogonally to the upper horizontal surface 75 of the arm. Each arm supports a moveable contact bridge 23 (FIGS. 1 and 3). The contact bridge 23 is a substantially planar member having interior wall portions defining a central aperture 76 dimensioned to clear head 74 and neck 72. The contact bridge rests on horizontal surface 75 of the arm. The aperture and the circumference of the neck, adjacent to the horizontal surface, are of non-circular configuration arranged to define the proper position of the contact bridge 23. This aligns the bridge contact buttons 84, that are positioned on opposing sides of the aperture, with the contact buttons 46 of the stationary contact terminal assemblies. FIGS. 1, 8 and 9 illustrate this, normally open contact, configuration. In the preferred embodiment, the aperture 76 and the adjacent, concentric, mating portion of neck 72 have a substantially rectangular circumference.

Each contact bridge 23 is retained on its arm 21 by a helical spring 78 that extends about the pin member. The spring is normally slightly compressed with its bottom turn abutting the upper surface of the contact bridge and its top turn 82 being captured on the underside of head 74. This provides proper contact pressure during contact closure. Upon energization of the electromagnet, initial, e.g. partial, movement of the contact carrier, causes the contact buttons of the bridge to abut with those of the stationary terminals. Subsequent to this initial contact closure, the contact carrier moves an additional distance until armature 18 abuts the pole faces of the electromagnet 14. This provides the required overtravel, or wear allowance.

ASSEMBLY OF CONTACT BRIDGE ON CONTACT CARRIER

Arm 21, including the pin member 68 and 70, spring 78 and contact bridge 23 are configured for rapid and easy assembly, and for minimum radial spring expansion during initial insertion of spring 78. The contact bridge 23 is placed on horizontal surface 75 of the arm so that it extends between flanges 80, and spring 78 is subsequently inserted on the pin member so that its top turn 82 is captured by head 74. Spring insertion is preferably accomplished by tool 90, as described subsequently.

Helical spring 78 has a plurality of turns having an inside diameter greater than the inside diameter of its top turn. In the preferred embodiment the spring bar has a conical cross section. The pin member (68 and 70) comprises non-circular, i.e. substantially rectangular, cross sections. The pin member, including its head and neck, has one set of opposing planar sidewalls 86 and 88 (FIG. 9) that are parallel to one another and are separated by a distance smaller than the inside diameter of the top turn, 82, of the spring.

Figure 8A:
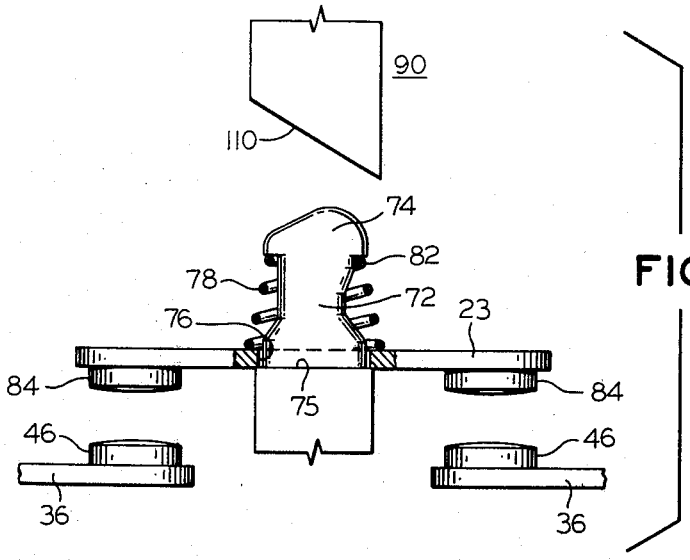
FIGS. 8A and 8B are side views and FIG. 9 is a front view of the assembly of the moveable contact bridge on the arm of the moveable contact carrier.
Figure 9:
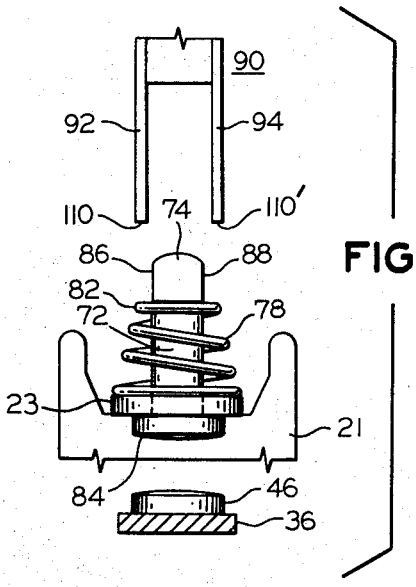
Figure 8B:
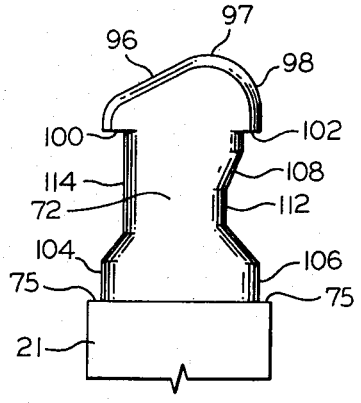

As illustrated in FIGS. 8A and 8B, the pin member has the following contour in the plane orthogonal to the sidewalls 86 and 88: Head 74 comprises first and second wall sections, 96 and 98 that extend from apex 97 and terminate, respectively, in first and second flanged end portions 100 and 102. Neck 72 has a base, abutting horizontal surface 75, whose endwalls 104 and 106 are substantially planar and parallel. The end and sidewalls of the base are configured to fit in the aperture 76 of the contact bridge, and to prevent excessive axial motion of the contact bridge. The endwalls 104 and 106 are preferably separated by a distance smaller than the inside diameter of at least the bottom turn of the spring, to permit the spring to clear the base. As further illustrated in FIG. 8B, neck 72 has a canted wall portion 108 extending inwardly and downward from flanged end portion 102. Wall portion 108 and the first wall section 96 of the head extend obliquely. The oblique angles of walls 108 and 96 are selected to maintain only slight expansion of spring 78 during its insertion at an oblique angle. This oblique spring insertion angle is established by the canted lower faces 110 and 110′ of insertion tool 90.

An additional wall portion 112 extends between wall portion 108 and end wall 106 of the base of neck 72, such that walls 108 and 112 define a concave surface. The opposing end wall 114 extends substantially longitudinally, i.e. vertically, between flanged end portion 100 and end wall 104 of the base. Thus the base portion of the neck, defined by sidewalls 104 and 106, is wider than the upper neck portion defined by walls 114, 108 and 112.

Spring insertion is preferably accomplished with insertion tool 90 which has a pair of displaced parallel blades 92 and 94 (FIGS. 8A and 9). The spring is initially placed on the pin member. The tool is then positioned over the head of the pin member with the blades extending parallel to the flat sides 86 and 88 of the member. The distance between the opposing inner walls of the blades slightly exceeds the width of the vertical member, i.e. the distance between sides 86 and 88. The tool is pushed down over the pin member so that the blades slide down adjacent to sides 86 and 88. The bottom surfaces 110 and 110′ of the blades are canted so that the top turn of the spring is inserted at an oblique angle. Referring to FIGS. 8A and 8B, the right side of the top turn is initially pushed down over wall section 98 to flange 102, while the left side of the top turn is still travelling on canted wall section 96. Thus the right side of the top turn is inserted before the left side. Further longitudinal movement of the tool pushes the left side of the top turn down wall section 96 until it catches under flange 100. Thus the top turn is inserted in two sequential steps instead of being inserted simultaneously over the pin head. In summary, the top turn snaps under flange 102 prior to snapping under flange 100 because the spring is inserted at an oblique angle and because of the arrangement of wall sections 96 and 98. Wall section 98 descends steeply in respect to wall section 96. Wall section 98 descends steeply in respect to the angle of face 110 of the insertion tool to assure that the tool does not bind and pinch the top turn against wall section 98. After the top turn of the spring has snapped over flanged end portion 102, the top turn descends with its opposing sides riding on wall section 96 and wall portion 108. Wall section 108 slopes inward from flanged end portion 102 so that there is some, but only slight, expansion of the top turn until it snaps over flanged end portion 100. The design of neck 72 prevents lateral displacement and resulting dislodging of the top turn of the inserted spring. This results because the width of the neck between flanged portions 100 and 102 is sufficient to prevent such displacement, i.e. equal to the inside diameter of the top turn of the spring.

The described arrangement minimizes radial expansion of the top turn of the spring. In a conventional arrangement the spring is simultaneously inserted longitudinally over a cylindrical head and thus must expand radially about its entire circumference. In the described arrangement, radial expansion of the top turn is required only in one plane, i.e. the plane of the sidewalls. Additionally, radial expansion is minimized by snapping the top turn over only one side of the head at a time. This two step insertion avoids simultaneous expansion of the turn in opposing directions. Expansion is thus minimized to about one-half that of the conventional arrangement. Since the degree to which the spring wire must radially expand and snap back limits the maximum diameter of the wire, a spring having an increased diameter can be utilized. The resulting spring is thus capable of exerting increased spring force, which increases contact pressure between the contact bridge and the stationary contacts.

ASSEMBLY OF ELECTROMAGNET

As illustrated in FIGS. 1, 2 and 3, the base of the arc chute comprises leg members 116 and 118 extending downward at the opposing ends of intermediate walls 32. The electromagnet assembly is supported by support member 12 which is fastened, e.g. by screws, to the bottom of the leg members.

The support member 12 is preferably made of metallic sheet stock. The substantially rectangular member 12 has arms 122 and 124 extending longitudinally in opposing directions. Partial serrations adjacent to end tabs 126 and 128 permit the tabs to be bent parallel to the horizontal plane of support plate 134, and to the bottom surface of the arc chute legs. Screws 130 and 132 engage into the bottom of the leg members through holes in the tabs. The arms are of sufficient length so that they will bend at an oblique angle in respect to support plate 134. This causes plate 134 to exert an upward force which clamps the electromagnet assembly against the arc chute. Support plate 134 of support member 12 has upward extending protrusions that prevent lateral movement of magnet member 14. In the preferred embodiment, these comprise four bosses 160 positioned near the corners of base 138 of the magnet member.

The electromagnet assembly comprises the magnet member 14, coil assembly 16, and pole shader rings 15 and 17. In the preferred embodiment, member 14 is a standard E-shaped magnet having outside legs 154 and 156 and intermediate leg 136. Coil assembly 16, further described below, sits on the base 138 of the magnet with intermediate leg 136 extending through the central aperture of the coil assembly. Pole shaders 17 and 15 are mounted on the outside legs 154 and 156 of the magnet member 14.

Figure 10:
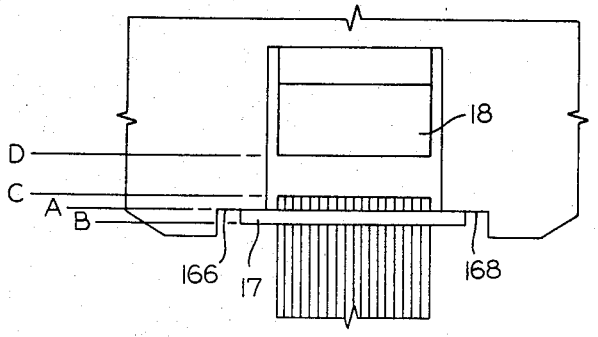
FIG. 10 is a partial side view of the assembled contactor.

Pole shaders 15 and 17, of the preferred embodiment, are of substantially rectangular configuration and have interior walls defining a central aperture. They are seated, i.e. nested, on surfaces that are recessed below the top face of the magnet legs, such that the top face of the magnet poles, i.e. the planar surface confronting the armature, is at a predetermined distance from the upper surface of the pole shaders. The recessed portions comprise parallel grooves 162 and 164 extending from the front of the rear of each leg. Groove 162 extends adjacent and orthogonal to the outer sidewall of the magnet leg. Groove 164 is displaced away from the inner sidewall of the leg so as to extend intermediate portions of the top face of the magnet poles. The pole shaders, when nested in the recessed surfaces 162 and 164, have portions extending transversely outward from the magnet legs. As illustrated in FIGS. 1 and 10, these outward extending flange portions, at the longitudinal ends of the pole shaders, abut a platform on the arc chute sidewalls 28 and 30. This platform comprises horizontal wall surface 166 and 168. The support member 12 exerts upward pressure on the magnet member and thus presses the nested pole shaders against the arc chute. This arrangement not only rigidly retains the magnet assembly, but additionally obviates the need to fasten the pole shaders to the magnet legs, such as by crimping or cementing.

As illustrated in FIG. 2, sidewalls 28 and 30 of the arc chute have a rectangular opening defined by horizontal wall 170 and opposing vertical wall members 172 and 174. This opening located at the lower portion of each of the sidewalls provides for clearance of armature 18 as the latter moves between its raised and lowered positions. The horizontal wall portions 166 and 168 extend transversely at the bottom of this opening. These wall portions define the height of the electromagnetic assembly. Thus, they also define the height of the pole faces of the magnet legs in respect to the arc chute assembly. This occurs because the poleshaders 15 and 17 have a predetermined thickness and the grooves 162 and 164 extend a predetermined depth below the surface of the pole faces. This is illustrated in FIG. 10. Assume that walls 166 and 168, and therefore the top surface of the abutting poleshaders are at a height A. The lower surface of the poleshaders, and thus the bottom of grooves 162 and 164 are at height B. The polefaces of the stationary magnet legs are therefore at a height C. Thus it can be seen that the height of the polefaces can be defined by the height of the wall portions 166 and 168.

Energization of the electromagnet assembly results in movement of the armature and contact carrier. After partial movement, the contact buttons of the moveable contact bridges 23 initially abut the stationary contacts. At this position, known as the "kiss position," the lower surface of the armature is at a height identified as D in FIG. 10. The contact carrier and armature continue to move to a final position at which the armature abuts the polefaces of the stationary magnet. The distance travelled by the lower face of the armature, from the "kiss position," D of FIG. 10, to the final position, C of FIG. 10, is critical. This distance is known as the "overtravel allowance," "wear allowance," or "wipe." The final position is defined by the height of horizontal wall portions 166 and 168.

In conventional contactors, tolerance build ups associated with various components of the contactor assembly can substantially and excessively modify the overtravel allowance. Typically, these components would include the armature, the moveable contact carrier, the moveable contact bridges, the stationary contact terminals, the arc chute, and the stationary magnet assembly. However, with the subject contactor, tolerance build up can be substantially reduced, e.g. to perhaps one third of that previously encountered. This is accomplished by controlling, e.g. by machining, the height of wall portions 166 and 168. Tolerance build up is then limited only to tolerances in the thickness of the poleshaders and the depth of the grooves of the magnet legs and the machinery operation.

During the manufacture of the contactor, stationary contact terminals 36 are secured in the compartments of arc chute 10. Armature 18 and moveable contact carrier 20 are assembled and inserted into the arc chute 10. The moveable contact bridges 23 are inserted on the arms 21 of the carrier and secured by insertion of springs 78. Subsequently, a force is directly applied to the top of the resiliently mounted moveable contact bridges until the latter just touch the stationary contacts. This results in partial displacement of the contact carrier to the kiss position with the lower surface of the armature at the height identified as D in FIG. 10. As previously explained, there is a predetermined distance between height D and the appropriate height A of wall portions 166 and 168 on the sidewalls. The arc chute can be molded so that the lower platform of the sidewalls initially extends below height A. The platform is then machined so that wall portions 166 and 168 are at the predetermined distance from height D, i.e. at height A. The electromagnet assembly with the inserted pole shaders is then assembled to the arc chute as previously described.

The contactor assembly has an optional top cover 120 (FIG. 3) secured to the top of the arc chute to cover the moveable and stationary contact members. The cover has four orthogonal tab members 121 that extend between the intermediate wall 32 and sidewalls 28 and 30 of the arc chute. The cover is fastened by screws extending through the top cover and engaging in the top of the intermediate wall.

COIL ASSEMBLY

Coil assembly 16 comprises an integrally molded plastic spool body comprising interior coil walls 140 and 141 which extend radially about the longitudinal axis of the coil, and upper and lower flange portions 158 and 159 that extend orthogonally outward from the top and bottom of the coil walls so as to extend about the coil wound about the coil walls. In the preferred embodiment, the coil walls comprise orthogonal side and end walls 140 and 141 forming an aperture of rectangular cross section and dimensioned to permit insertion of the intermediate magnet leg 136 through the aperture. The coil walls and flange portions preferably are of sufficient thickness to be rigid and to provide structural support for the coil and to withstand the force of abutting components, e.g. magnet 14, arc chute 10, and return springs 60. Upper flange portion 158 has bosses 62 for supporting springs 60 and guide members 145 for interfacing with cooperating members of arc chute 10. The upper flange portion 158 also has lip portion 152. Current carrying terminals 148 and 150 are crimped to member 152. The latter also has outwardly extending plastic projections 143 extending over, and serving as insulation for, the terminals.

Figure 11:
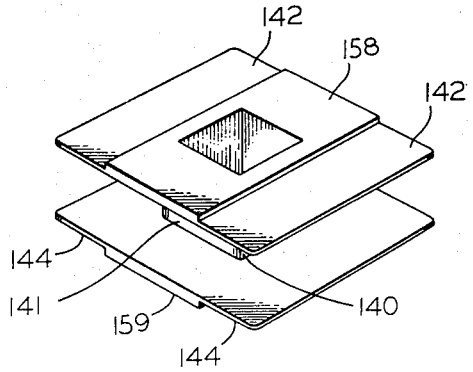
FIG. 11 is a simplified perspective view of the molded plastic spool body utilized in the coil assembly.

Flange portions 158 and 159 further have flap extensions 142 and 144 at each of their long sides. The flap extensions are integrally molded components of the spool body, but are sufficiently thin to be flexible so as to permit their being folded as illustrated in FIG. 3. As shown in FIG. 11, the flap extensions are initially maintained in the plane of their associated flange portions. This readily permits coil 146 to be wound about the coil walls. The coil ends are connected, e.g. welded or soldered to terminals 148 and 150.

When the coil assembly is to be mounted on magnet 14, the flap extensions 142 and 144 are folded over each other as shown in FIG. 3. Members 142 and 144 have sufficient width to permit such overlap. Upon insertion of the coil assembly on intermediate magnet leg 136, the overlapping flap extensions provide necessary insulation between the coil and the interior walls of the exterior magnet legs 154 and 156. In addition, the flap extensions also assist in maintaining a snug fit between the coil assembly and the magnet. The described arrangement obviates the need for applying additional insulation, e.g. by taping or encapsulation, after the coil is wound.

The described coil assembly can readily be modified to permit its use with other types of contactor configurations or with other types of electric apparatus. For example, it can be applied to spools having a plurality of coils cascaded adjacent to one another on the coil walls. In such an arrangement additional flange portions with flap extensions could be employed between adjacent coils.

Although the inventions have been described with reference to a specific embodiment thereof, numerous modifications thereof are possible without departing from the inventions and it is desirable to cover all modifications falling within the spirit and scope of these inventions.

What I claim as new and desire to secure by Letters Patent of the United States is:

1. In an electromagnetic contactor having an armature resiliently biased in spaced relation to an energizable magnet, a moveable contact carrier adapted to move responsive to attraction of the armature by the magnet, a pin member comprising a head portion and a neck portion extending from the moveable contact carrier, a moveable contact bridge extending about the pin member, a helical spring engaged between the head portion of the pin member and the contact bridge to resiliently support the contact bridge on the carrier so that movement of the contact carrier engages the contact bridge with stationary contact means, the combination comprising:

(a) the contact carrier comprising a surface adapted to support at least one contact bridge;
(b) the pin member extending from the surface of the contact member;
(c) the contact bridge comprising interior walls defining an aperture and adapted to extend about the pin member;
(d) the helical spring comprising a top turn and additional turns having an inside diameter greater than the inside diameter of the top turn;
(e) the pin member comprising opposing sidewalls displaced from one another by a distance smaller than the inside diameter of the top turn of said spring;
(f) the pin member being contoured in a direction orthogonal to said sidewalls with;
  (1) the head portion comprising first and second sloping wall sections terminating respectively in first and second flanged end portions displaced from one another to capture the top turn of said helical spring;
  (2) the neck portion comprising wall portions configured to facilitate initial insertion of the helical spring into the pin member at an oblique angle so that said top turn is captured sequentially by said second and said first flange portions whereby spring insertion is achieved with minimal radial displacement of the turns of the spring.

2. The arrangement of claim 1 wherein the pin member is contoured in a direction orthogonal to said sidewalls so that the neck portion comprises one wall portion abutting the second flanged end portion and an adjoining wall portion indented therefrom inwardly toward the longitudinal central axis of the pin member.

3. The arrangement of claim 2 wherein the pin member is contoured in a direction orthogonal to said sidewalls so that the neck portion comprises said one wall portion and a second wall portion abutting the first flanged end portion, said one and second wall portions being displaced from one another sufficiently to prevent lateral displacement of the top turn of the spring subsequent to its insertion.

4. The arrangement of claim 1 wherein the interior walls of said contact bridge define a non-circular aperture and the neck portion of the pin member has a base adjacent to the upper surface of the moveable contact carrier configured to maintain the contact bridge in axial alignment.

5. The arrangement of claim 4 wherein the neck portions of said pin member is contoured in a direction orthogonal to said sidewalls such that the cross section of the neck portion intermediate its base and said head portion has a smaller cross sectional area than the cross sectional area of the base.

6. The arrangement of claim 5 wherein the pin member is contoured in a direction orthogonal to the sidewalls such that the neck portion intermediate the base and said head portion has one substantially planar wall portion extending between said first flanged end portion and said base in a direction substantially orthogonal to the upper surface of the contact carrier.

7. In an electromagnetic contactor wherein an energizable magnet is secured in spaced relation to an arc chute, a longitudinally moveable contact carrier extends through the arc chute, an armature secured to one end of the moveable contact carrier is resiliently biased in relation to the energizable magnet, the combination comprising:

(a) said arc chute comprising a plurality of compartments;
(b) stationary contact means fixed in said compartments;
(c) said moveable contact member at its other end comprising at least one arm member;
(d) at least one pin member comprising a neck portion and a head portion extending from said arm member;
(e) a moveable contact bridge having internal walls defining an aperture adapted to extend about the pin member;
(f) said moveable contact bridge being supported on said arm member so as to be in juxtaposition with said stationary contact means;
(g) a helical spring, adapted for engagement between the head portion of the pin member and the moveable contact bridge, comprising a top turn and additional turns having a diameter greater than that of the top turn;
(h) said head portion comprising a major dimension smaller than the inside diameter of the top turn of the spring in a first longitudinal plane extending through the longitudinal axis of the pin member;
(i) said head portion being contoured in a second longitudinal plane extending orthogonally to the first longitudinal plane to comprise:
  (1) radially displaced flanged end portions joining the neck portion and adapted to capture the top turn of the spring upon its insertion between the head portion and the moveable contact bridge;
  (2) an apex disposed intermediate said flanged end portions to provide first and second head contour surfaces of different slope extending from the apex to the flanged end portions;
(j) the neck portion being configured to facilitate insertion of the spring at an angle oblique to the longitudinal axis so that the top turn of the spring engages the flange portion adjoining the contour surfaces having the steeper slope prior to engaging the flange portion adjoining the other one of the contour surfaces whereby radial displacement of the top turn of the spring is reduced.

8. The arrangement of claim 7 wherein the neck portion is contoured in the second longitudinal plane to have a width adjacent to the flanged end portions approximating the inside diameter of the top turn of the spring to prevent lateral displacement and dislodging of the top turn of the spring subsequent to its insertion.

9. The method of assembling a moveable contact member on the moveable contact carrier of an electromechanical contactor comprising the steps of:

(a) providing a helical spring having a top turn and additional turns of diameter larger than that of the top turn;

(b) providing the moveable contact carrier with a support surface and a pin member comprising opposing sidewalls displaced from one another by a distance not exceeding the inside diameter of the top turn of the spring, the pin member being contoured in a direction orthogonal to the sidewalls with a head portion having flanged end portions and a neck portion;

(c) inserting the moveable contact member comprising interior walls defining an aperture over the pin member so as to rest on the support surface;

(d) placing the helical spring on the pin member;

(e) providing an insertion tool comprising a pair of parallel blades having lower faces canted at an oblique angle, the blades being displaced from one another by a distance exceeding the distance between the sidewalls of the pin member;

(f) positioning the pin member under the blades of the insertion tool with the blades extending parallel to the sidewalls of the pin member;

(g) pushing the insertion tool over the pin member with the blades sliding down adjacent to the sidewalls so that the top turn of the spring is inserted at an angle oblique to the longitudinal axis of the pin member and the top turn sequentially snaps over the end portions of the pin member.

* * * * *